US009326326B2

(12) United States Patent
Brunelle et al.

(10) Patent No.: US 9,326,326 B2
(45) Date of Patent: Apr. 26, 2016

(54) COMFORT BATHTUB WITH HEATED WALL PORTIONS

(75) Inventors: Henry Brunelle, Québec (CA); Louis Gendreau, Sainte-Marie (CA); Danny Grenier, Québec (CA); Guy Baillargeon, St-Etienne de Lauzon (CA); Dave Thomas, St-Romuald (CA)

(73) Assignee: GESTION ULTRA INTERNATIONALE iNC, St-Nicholas (CA)

( * ) Notice: Subject to any disclaimer, the term of this patent is extended or adjusted under 35 U.S.C. 154(b) by 491 days.

(21) Appl. No.: 13/172,995

(22) Filed: Jun. 30, 2011

(65) Prior Publication Data

US 2013/0000032 A1 Jan. 3, 2013

(51) Int. Cl.

| | |
|---|---|
| ***A47K 3/00*** | (2006.01) |
| ***H05B 3/34*** | (2006.01) |
| ***A47K 3/02*** | (2006.01) |

(52) U.S. Cl.
CPC ... *H05B 3/34* (2013.01); *A47K 3/02* (2013.01)

(58) Field of Classification Search
USPC ..... 4/598, 545, DIG. 6
See application file for complete search history.

(56) References Cited

U.S. PATENT DOCUMENTS

| | | | | |
|---|---|---|---|---|
| 3,597,586 | A * | 8/1971 | Rebovich | 219/219 |
| 4,011,430 | A * | 3/1977 | Witkin et al. | 219/486 |
| 4,333,626 | A * | 6/1982 | Holbrook | 248/689 |
| 4,346,339 | A * | 8/1982 | Lewandowski | 323/245 |
| 4,889,973 | A * | 12/1989 | Farinacci et al. | 219/528 |
| 5,761,753 | A * | 6/1998 | Talbert | 4/559 |
| 6,140,615 | A * | 10/2000 | Matsumoto | 219/441 |
| 8,258,443 | B2 * | 9/2012 | Caterina et al. | 219/530 |
| 2006/0015998 | A1 * | 1/2006 | Whitinger et al. | 4/545 |
| 2006/0130228 | A1 * | 6/2006 | Lebrun et al. | 4/545 |

OTHER PUBLICATIONS

Defintion of Integral. Merriam Webster.*

* cited by examiner

*Primary Examiner* — Lauren Crane
*Assistant Examiner* — Erin Deery
(74) *Attorney, Agent, or Firm* — Norton Rose Fulbright Canada LLP; Alexandre Daoust

(57) ABSTRACT

A comfort bathtub has at least one heated wall portion which is comprised by a composite pliable heat generating envelope integrated with the wall portion. The heat generating envelope has a heated mesh sandwiched between a pair of protection film sheets bonded together about the heated mesh to isolate the heated mesh from molded material of the bathtub. The composite pliable envelope has electrical connections secured to a power supply. A temperature sensor is in communication with the envelope for sensing the temperature thereof. A voltage regulator controls the power supply through a control circuit to regulate the heat generated by the heated mesh. The composite pliable envelope is configured to heat a discrete wall portion of the bathtub to provide a discrete external heated surface of the bathtub.

13 Claims, 4 Drawing Sheets

COMFORT BATHTUB WITH HEATED WALL PORTIONS

TECHNICAL FIELD

The present invention relates to a comfort bathtub having at least one heated wall portion which is heated by a heated mesh concealed in a pliable envelope which is integrated with an associated discrete wall portion of the bathtub to provide heat on the external surface thereof in contact with a user person.

BACKGROUND ART

It is known to heat wall portions of a bathtub to provide comfort to a user person. Such heat is usually provided by electrical resistive elements secured to the external surface under the bottom of the bathtub or the side walls thereof. It is also known to provide conduits in the walls of a bathtub to circulate hot air by the use of a blower. A disadvantage of these devices is that they are costly to adapt to bathtubs and often cannot adapt to curved or molded portions of the bathtub thereby being incapable to heat curved wall portions where heat may be desired. Another disadvantage of these known devices is that they get damaged during transport and installation and often break down due to their life span and are difficult to repair due to limited access in the space under a bathtub. Another disadvantage of these devices is that they do not provide even heat distribution throughout their covered area and as stated above, are often non-adaptable to certain areas of a bathtub.

SUMMARY OF INVENTION

It is a feature of the present invention to provide a comfort bathtub having at least one heated wall portion and which substantially overcomes the above-mentioned disadvantages of the prior art.

Another feature of the present invention is to provide a comfort bathtub in which there is integrated in its wall construction a heat generating envelope having a heated mesh sealed in the envelope and wherein the envelope is incorporated in the molded material of the bathtub.

Another feature of the present invention is to provide a comfort bathtub having a composite pliable envelope which is configured to heat discrete wall portions of a bathtub to provide discrete external heated surfaces in the bathtub walls to provide comfort to a user person.

According to the above features, from a broad aspect, the present invention provides a comfort bathtub having at least one heated wall portion. A composite pliable heat generating envelope is integrated in the wall portion. The heat generating envelope has a heated mesh sandwiched between a pair of protection film sheets bonded together about the heated mesh to isolate the heated mesh from molded material of the bathtub. The composite pliable envelope has electrical connections secured to a power supply. A temperature sensor is in communication with the envelope for sensing the temperature thereof. A voltage regulator is provided for controlling the power supply though a control circuit to regulate the heat generated by the heated mesh. The composite pliable envelope is configured to heat a discrete wall portion of the bathtub to provide a discrete external heated surface of the bathtub.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
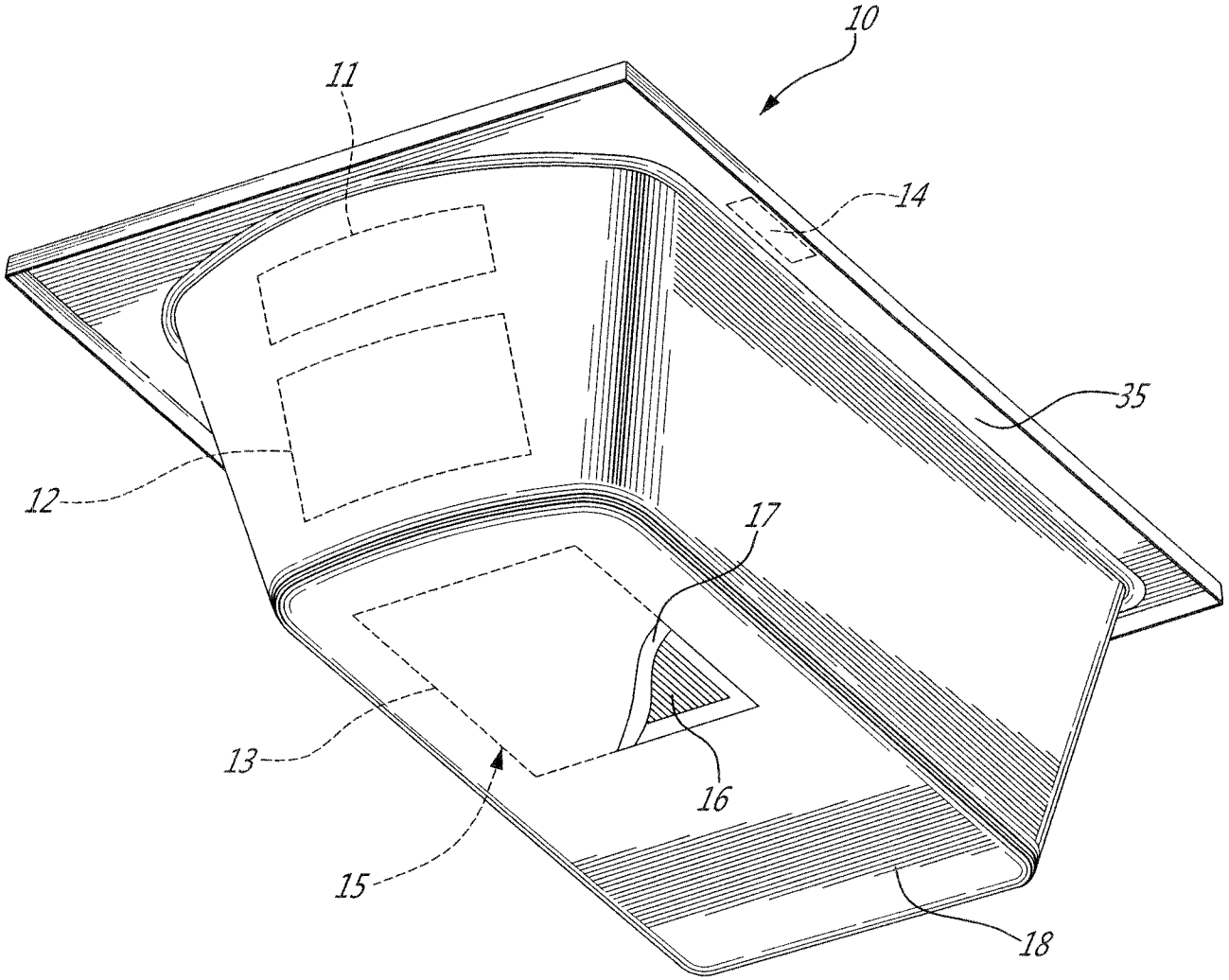
FIG. 1 is a perspective view as shown from underneath a bathtub showing discrete wall portions in which is integrated heat generating envelopes to heat the external surface of the discrete wall portions.

Referring now to the drawings and more particularly to FIGS. 1 to 4, there is shown generally at 10 a comfort bathtub constructed in accordance with the present invention. As herein shown, the bathtub has four heated wall portions delineated by phantom lines and namely a neck heated wall portion 11, a back heated wall portion 12, a seat heated wall portion 13 and a flange wall heated portion 14. These heated wall portions are heated by heat generating envelopes 15 as shown in FIG. 2A. Each heat generating envelope 15 has a heated mesh 16 which is sandwiched between and isolated by a pair of protection film sheets 17 and 17' which are bonded together by a suitable glue which is non-reactive with the mesh 16 whereby to isolate the heated mesh from molded material 18 forming the bathtub 10. The molded material as herein shown is a mixture of fiberglass and resin which contains styrene which is non-compatible with the heated mesh. The heated mesh herein utilized is known as a HOT MESH (registered trade mark) and which is a pliable sheet of carbon resistive wires which has a rapid response time to provide accelerated heating throughout the mesh. The response time of such mesh is approximately 5 minutes to raise the temperature of a typical fiberglass molded bathtub to about 40° C. The heat generating carbon wires are spaced from one another and are non-flammable flexible heat conductors. The HOT MESH heated mesh provides substantially even heat distribution throughout its surface area. The HOT MESH heated mesh specification is herein incorporated-by-reference. Commonly, the HOT MESH heated mesh was developed to heat pavement in road surfaces.

Figure 2A:
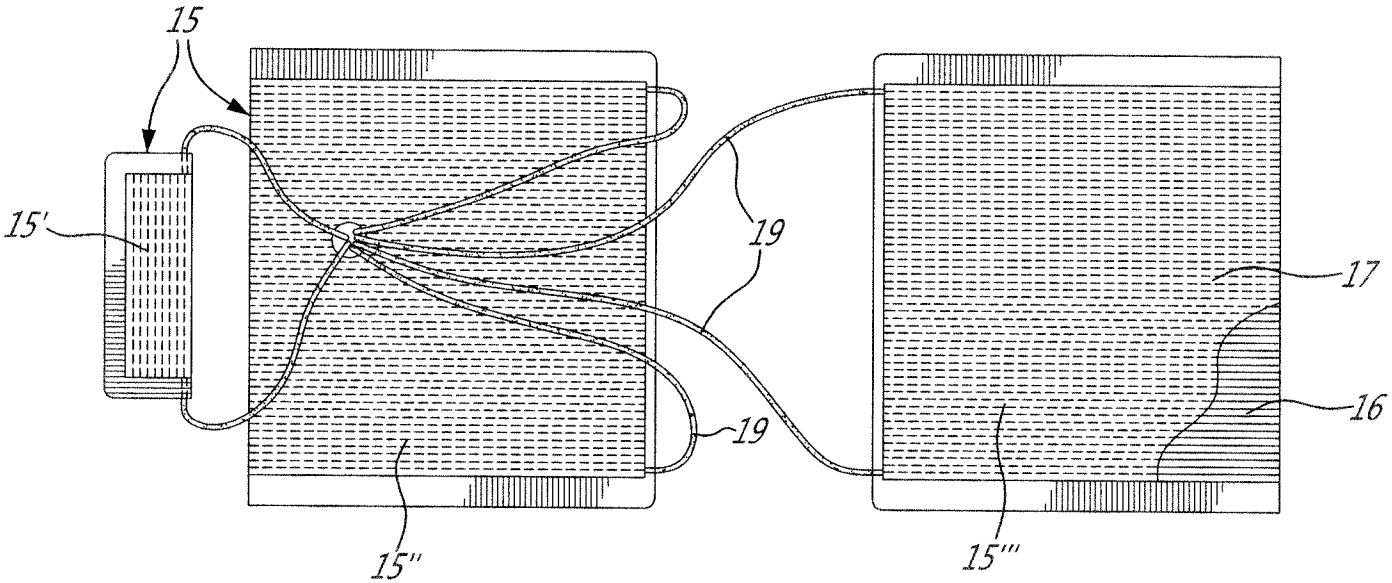
FIG. 2A is a plan view showing the construction of three heat generating envelopes interconnected together in parallel by electrical wiring.
Figure 3:
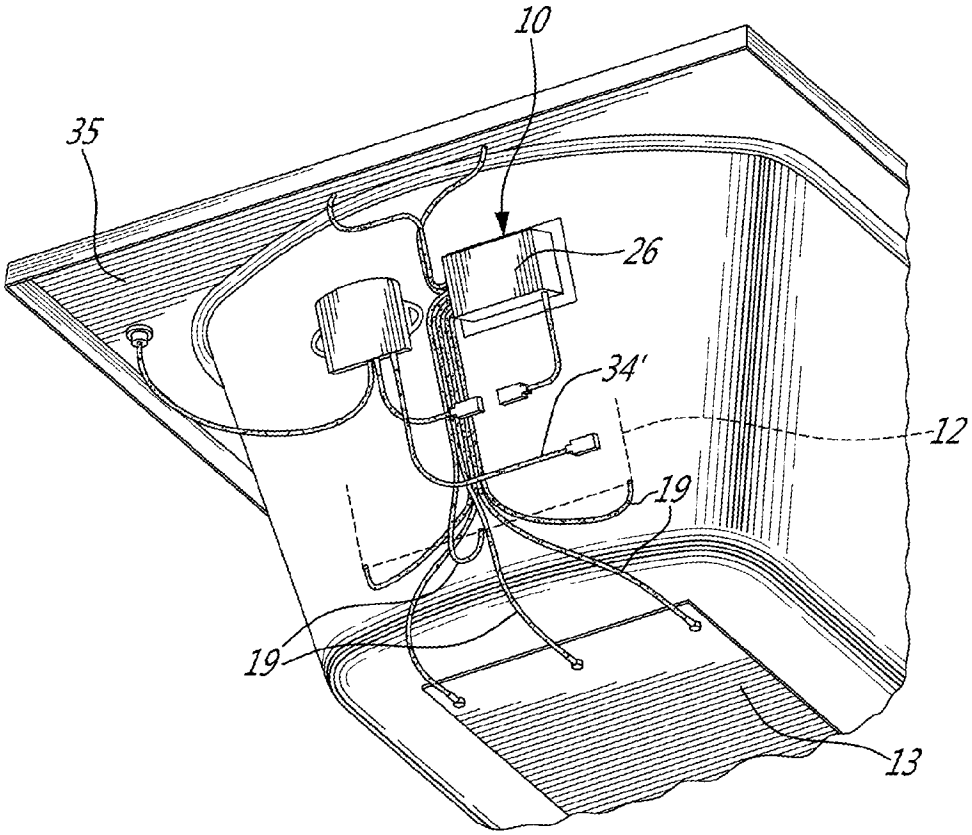
FIG. 3 is a fragmented bottom view of a bathtub showing the location of the junction box and a control box to provide regulated power to the heated mesh.

As shown in FIG. 2A, these heated mesh pliable sheets 16 are provided with a pair of electrical wires 19 to provide a current thereto to heat the mesh. As shown in FIG. 2A, there are three heat generating envelopes 15 interconnected in parallel by their wires 19. As shown, a first small elongated envelope 15' constitutes a neck heated portion as shown at 11 in FIG. 1. Envelope 15" constitutes the back heated portion 12 as shown in FIG. 1, and the envelope 15''' constitutes a seat heated portion as shown at 13 in FIG. 1.

Figure 2B:
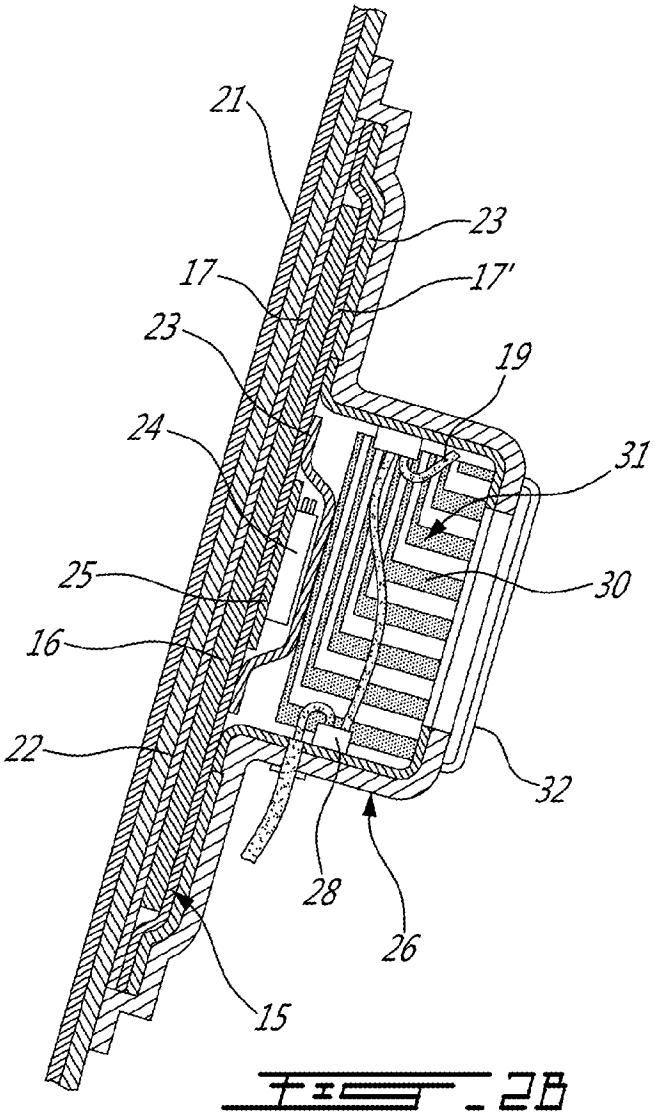
FIG. 2B is a section view through a bathtub wall showing the integrated pliable envelope of the present invention having a heated mesh isolated therein with the envelope integrated in the side wall material, and a junction box secured to an internal surface of the bathtub to house component parts associated with the envelope.

With reference now to FIG. 2B, there is shown the envelope 15 integrated with a wall portion 20 of the bathtub 10. The envelopes 15 are molded between two coats of fiberglass/resin and isolated therein for the reason as stated above. FIG. 2B is a cross-section view in an area where a junction box is secured adjacent a heat generating envelope. As hereinshown, the external surface 21 of the bathtub wall has an acrylic coating which is in contact with a user person. The wall of the bathtub is formed by resin and fiberglass layer 22. Another layer of resin and fiberglass is applied above the heated membrane envelope and its junction box to secure it in place.

Figure 4:
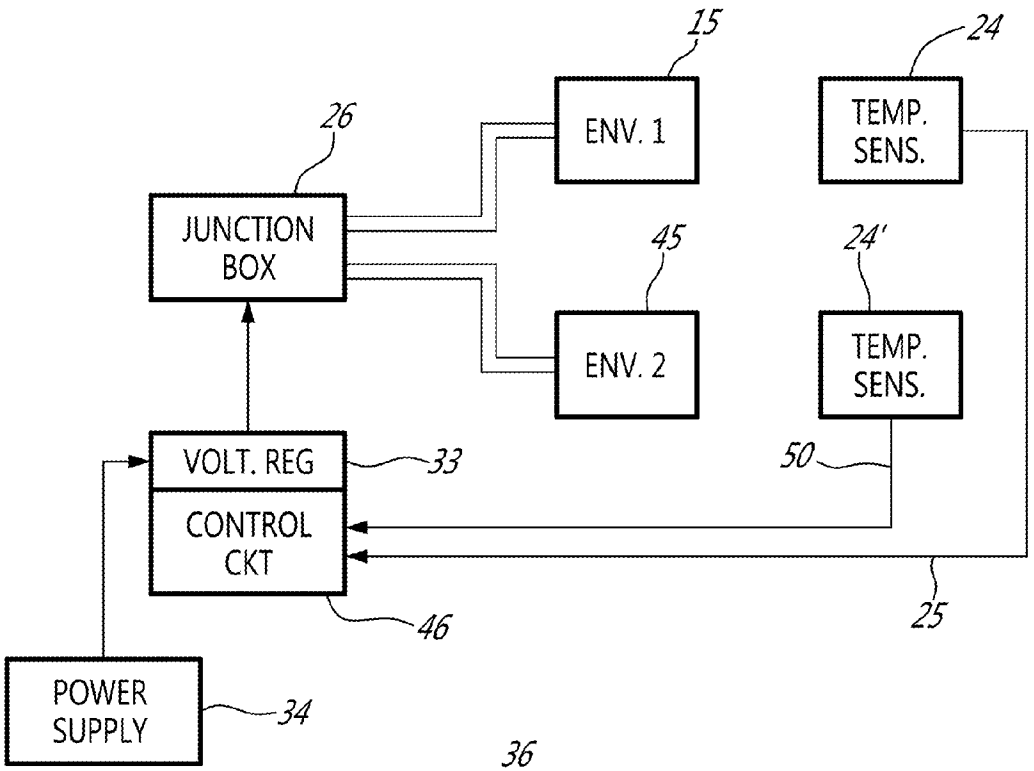
FIG. 4 is a simplified block diagram of the electrical supply circuit.

As herein shown the envelope 15 has a heated mesh pliable sheet 16 isolated by a pair of protective film sheets 17 and 17' sealed all about the heated mesh pliable sheet 16. These film sheets 17 and 17' are thin polyester film sheets having a specification as defined under UL 94 VTM 2. A polyethylene insulating closed-cell foam material 23 is applied over the heated mesh pliable sheet to direct the heat to the user. In the area of the junction box, a temperature sensor 24 which is in communication with the envelope for sensing the temperature thereof. As herein shown an aluminum tape 25 is disposed between the envelope and the sensor and is a good heat conductor. The sensor 24 is provided with an electrical connection 28 which connects to a control circuit 46, as shown in FIG. 4. The polyethylene closed-cell insulating foam 23 also concentrates the heat in the direction of the external surface of the bathtub wall and extends over the temperature sensor 24 to isolate it in the junction box 26. The junction box 26 has a polystyrene wall 27 which forms a chamber therein for access to electrical connectors 28 and wiring 29. A fiberglass insulating wool material 30 is inserted within the chamber 31 of the junction box to minimize heat loss through the junction box. A cover 32 provides access to the inside of the junction box.

As shown in FIG. 4, a voltage regulator 33, herein a TRIAC (Triode for Alternating Current), is controlled by the control circuit 46 whereby to control the power supply 34 which is connected to the conductors 19 of the envelope 15 via connectors 28 in the junction box 26.

As shown in FIGS. 1 and 2A, there are three discrete portions 11, 12 and 13 being heated by three discrete envelopes 15', 15'' and 15''' whereby to provide heat to the neck, back and seat portion of the bathtub to heat associated portions of a body of a user person sitting in the bathtub. These envelopes are of different sizes to provide different size heated external wall portions. The envelopes as shown in FIG. 2A are connected in parallel via their electrical leads 19 but it is also contemplated that each of these envelopes could be individually controlled. As shown in FIG. 4, for example, there are two envelopes independently controlled from one another. The second envelope 45 also has a temperature sensor 24' with an electrical lead 50 feeding a signal to the control circuit. In such an application, there would also be two voltage regulators to independently control each of the envelopes.

Figure 6:
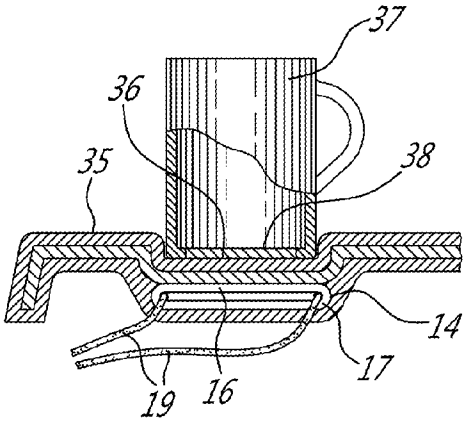
FIG. 6 is a fragmented section view showing a beverage cup being heated in a cup holder cavity, as shown in FIG. 5, and heated by a heat generating envelope of the present invention.
Figure 5:
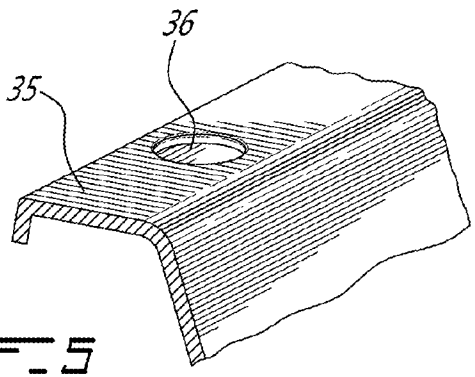
FIG. 5 is a fragmented section view showing an upper flange wall of a bathtub in which there is integrated a heated mesh to provide a heated surface to heat a removable object.

It is also within the ambit of the present invention to provide heat generating envelopes in other discrete areas of the bathtub to provide heat for other purposes than heating portions of a user person's body. For example, as shown in FIGS. 5 and 6, the flange wall 35 of the bathtub may be provided with a recessed cup holding cavity 36 under which is provided a small heat generating envelope such as that illustrated by reference numeral 14 to provide a heated cavity which receives a drinking cup 37, as shown in FIG. 6. The drinking cup 37 may be adapted for this purpose and be provided with a heat transmitting bottom wall 38 formed of thermal conductive material whereby to heat or maintain hot a heated liquid contained within the cup 37. Again, such a heat generating envelope could be independently controlled or controlled in association with the other heat generating envelopes.

It is within the ambit of the present invention to cover any obvious modifications of the preferred embodiment described herein, provided such modifications fall within the scope of the appended claims.

We claim:

1. A comfort bathtub comprising:

a heated wall portion having a heat generating envelope integrated therein, the heated wall portion having an access box area, an adjacent area surrounding the access box area, a fixed insulating foam layer integrated to the adjacent area of the heated wall portion, and an accessible insulating foam layer integrated the access box area of the heated wall portion, the fixed and accessible insulating foam layers insulating said heat generating envelope from an outside of the comfort bathtub to direct the heat to the user;

an access box made integral to the heated wall portion at the access box area and having a removable cover for allowing access to the accessible insulating foam layer;

a temperature sensor being removably mounted to said heat generating envelope at the access box area and insulated by the accessible insulating foam layer, the temperature sensor being in thermal communication with said heat generating envelope for sensing the temperature thereof and operatively connected to a control circuit connectable to an external power supply;

wherein the heat generating envelope is adapted to heat the wall portion to a temperature of 40° C. within five minutes.

2. The comfort bathtub of claim 1, wherein the heat generating envelope is molded between two coats of fiberglass/resin.

3. The comfort bathtub of claim 1, wherein the fixed and accessible insulating foam layers are different sheets of polyethylene closed-cell foam.

4. The comfort bathtub of claim 1, wherein the access box area is further covered by a fiberglass insulating wool material inside the access box, over the accessible insulating foam.

5. The comfort bathtub of claim 1 wherein there are three of said heated wall portions constituted by a neck, back and seat wall portion of said bathtub to provide heat to the neck, back and seat portion of a user person seated in said bathtub, there being three of said heat generating envelopes of different sizes to provide said heated wall portions.

6. The comfort bathtub of claim 5 wherein said three heat ene a in envelopes are electrically connected together in parallel.

7. The comfort bathtub of claim 6 wherein said three heat generating envelopes are independently controlled, there being one of said temperature sensor and a voltage regulator associated with each said three heat generating envelopes.

8. The comfort bathtub of claim 6 wherein said three heat generating envelopes each have two or three electrical supply wires disposed on an inner surface of said bathtub and coupled to a power supply cable through the access box secured to said inner surface.

9. The comfort bathtub of claim 1 wherein said heated wall portion is a recessed heating wall portion for conducting heat in a bottom wall of a drinking cup seated therein.

10. The comfort bathtub of claim 1 wherein said heated mesh comprises heat generating carbon wires which are non-flammable flexible heat conductors, said heated mesh having substantially even heat distribution throughout its surface area.

11. The comfort bathtub of claim 1 wherein said temperature sensor, a voltage regulator and electrical connectors are located in the access box, said electrical connectors being secured to a power supply cable accessible outside said access box for connection to a control box.

12. The comfort bathtub of claim 11 wherein said voltage regulator is a triode for alternating current.

13. The comfort bathtub of claim 1 wherein there are at least two or three of said heat generating envelopes, each envelope having two electrical supply wires connected to an associated power supply for independent temperature control of said at least two of said heat generating envelopes, each envelope having said temperature sensor and voltage regulator.

* * * * *